United States Patent [19]

Rhodes et al.

[11] Patent Number: 4,896,751

[45] Date of Patent: Jan. 30, 1990

[54] SELF-LINE BRAKE ADJUSTER

[75] Inventors: Wayne A. Rhodes, Luray; James W. Johnson, Jackson, both of Tenn.

[73] Assignee: Touchstone Railway Supply & Mfg. Co., Jackson, Tenn.

[21] Appl. No.: 283,964

[22] Filed: Dec. 13, 1988

[51] Int. Cl.[4] ..... F16D 65/52; F16D 65/14

[52] U.S. Cl. ..... 188/197; 188/210

[58] Field of Search ..... 188/197, 196 M, 215, 188/212, 210, 214

[56] References Cited

U.S. PATENT DOCUMENTS

| | | | |
|---|---|---|---|
| 2,633,936 | 4/1953 | Settles | 188/210 |
| 4,081,060 | 3/1978 | Touchstone | 188/197 |
| 4,729,324 | 3/1988 | List | 188/53 |

*Primary Examiner*—Robert J. Oberleitner
*Attorney, Agent, or Firm*—Head & Johnson

[57] ABSTRACT

A device for maintaining the proper lateral position of brake shoes with respect to the wheels of a locomotive. An adjusting bar is used to adjust the distance between the pull rod of the brakes and a bracket supported by the safety strap. A supporting axle has a locomotive wheel on each end so that there is a wheel on each rail. Each wheel has a brake which is provided with an adjuster bar. There is thus a left and a right adjuster bar. A tie bar extends from the left adjuster member to the right adjuster member to keep the brake shoes aligned with the respective wheels after there is wear in the various linkage connections.

2 Claims, 3 Drawing Sheets

SELF-LINE BRAKE ADJUSTER

BACKGROUND OF THE INVENTION

1. Field of the Invention:

This invention relates to brakes on locomotives and especially to means for improving the life of brake systems.

2. Description of the Prior Art:

Locomotives are supported from parallel rails by steel wheels. There are a plurality of axes which are perpendicular to the rails and support a wheel on either end, that is a left wheel on one rail and a right wheel on the other rail. In prior years, the diesel locomotives have used metallic brake shoes which are made from cast iron having certain other ingredients. Force is applied to the brake shoes to force them against the locomotive wheel. More recently, nonmetallic material has been developed and is used widely for use with brake shoes in lieu of the former cast iron material since the new material normally includes a composition of rubber and other components and has a higher coefficient of friction when in engagement with the steel wheels than the cast iron shoes.

One problem inherent in single brake shoes, which are widely used, remains. For example, the brake shoe wears out relatively rapidly and it becomes necessary to adjust the slack due to the wear thereon in order to maintain an efficient braking operation. U.S. Pat. No. 4,081,060 issued Mar. 28, 1978 to Roy H. Touchstone and entitled "Brake Adjustment Device for Converting Double Shoe Clasp-Type Brake Assembly to Single Shoe Brake Assembly" describes a widely used brake system. The brake adjuster described in that patent includes bracket means adapted to be secured to an end of the usual safety strap provided on the locomotive truck. Such system includes an independent slide bar attached to the bracket means and extending backwardly therefrom toward the wheels to be braked. A housing member is slidably disposed over the slide bar. The housing member terminates at its free end and the other end is secured to the brake levers. Complementary bores are provided in the slide bar and housing member in order to receive locking or keeper pins therethrough for securely retaining the housing member and slide bar in a preselected longitudinal relationship. The spacing between the bores is such as to provide substantially any desired longitudinal relationship between the slide bar and housing.

In the system just described, the slide bars are secured to the safety straps which is secured to the locomotive truck between the adjacent in-line wheels or adjacent one wheel and the relative position of the slide bar with respect to the wheels remain stationary. However, the housing members are in a longitudinal, reciprocal or floating relationship with respect to the respective slide bars and are in engagement with the brake levers. Thus, when the braking engagement between the brake shoe and the wheels must be adjusted for any reason, it is merely necessary to adjust the relative longitudinal position between the slide bar and the respective housing member and lock the two elements in the selected position by a keeper pin.

3. Problems with the Prior Art Braking Mechanism:

We have noticed that when brake assemblies using the slide bar and housing member just described that after awhile there develops "play" in the various pins and pivot points of the system. The locomotive wheels normally tend to slope slightly to the outside. Then, when the pivot points of the linkage system wear the brakes shoes will overhang, i.e., extend outwardly beyond the locomotive wheel so that the brake shoes are not in full contact as they should be. This can cause heat buildup to the point where it becomes a major problem and the locomotive car may be required to be removed from operations until corrections are made.

4. Object:

It is therefore an object of this invention to provide means whereby the brake shoes will not ride to the outside and have the overhanging problem.

SUMMARY OF THE INVENTION

Locomotives are supported by axles each having a left wheel and a right wheel which ride along two rails of a railroad track. Each has a brake with a brake shoe for applying against its wheel for applying braking action. There is an adjuster assembly between the pull rod associated with the braking apparatus and a safety strap supported from the locomotive truck. The adjuster assembly includes a slide bar and a trunnion into which the slide bar is inserted and means are provided to lock the two together in any of several selected longitudinal relationships.

A lateral tie bar connects the adjuster assembly of the left wheel with the adjuster assembly of the right wheel. The tie bar is to prevent or reduce the possibilities of the brake shoes from riding to the outside edge of that brake shoe's associated tapered wheel when the various linkage mechanism becomes slightly worn to the point that there is slack in the linkage. The brake shoe on the left wheel and the brake shoe on the right wheel will each have a tendency to shift to the outside. However, with the tie bar connecting the slack adjuster assemblies and inasmuch as each shoe will have a tendency to shift to the outside, this rigid tie bar will prevent lateral movement of either or both brake shoes. The full braking area of each shoe is thus always utilized. This is a function not heretofore obtained.

DESCRIPTION OF THE PREFERRED EMBODIMENT

Figure 1:
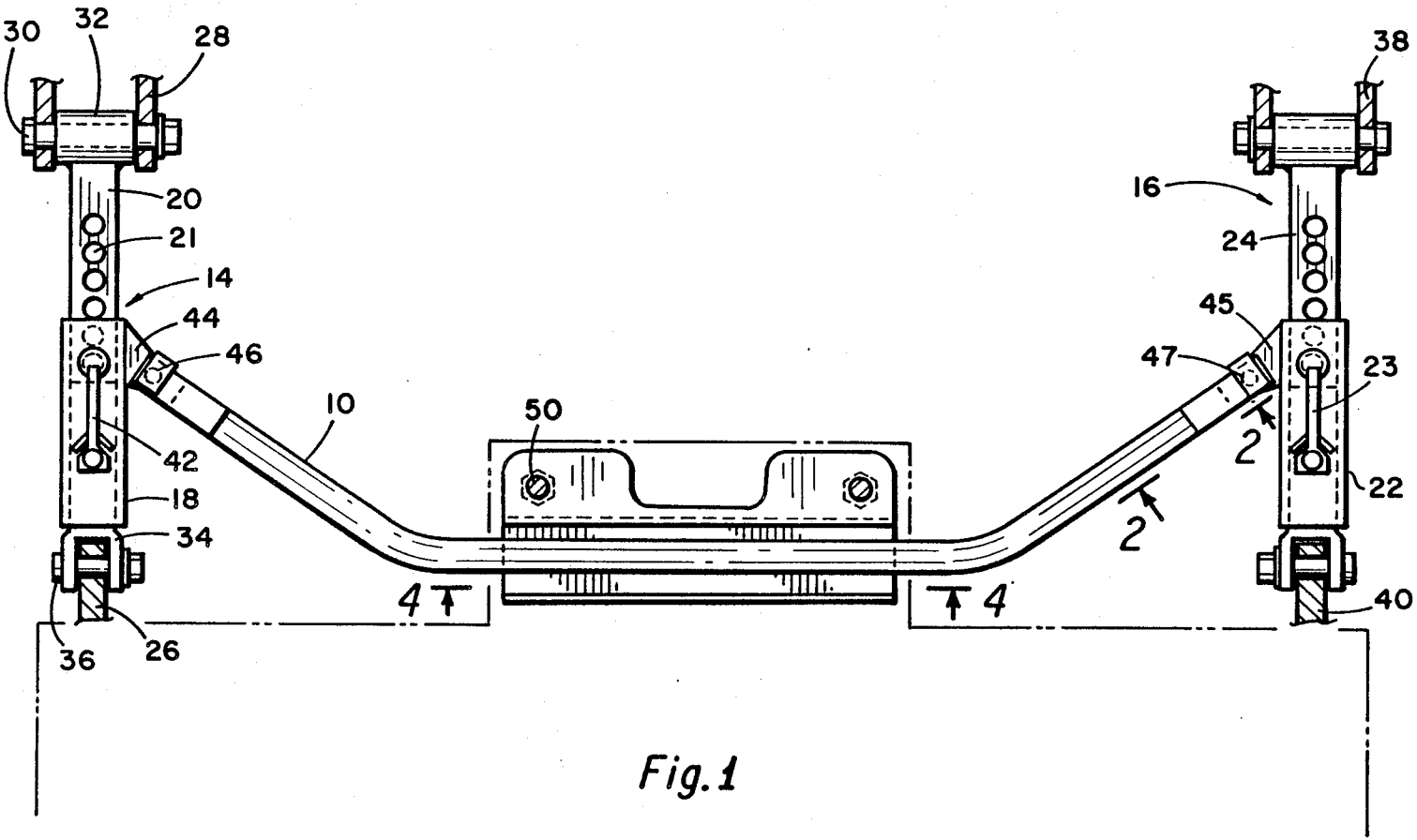
FIG. 1 is a plan view of a safety tie bar connecting adjuster assemblies on the left wheel brake assembly and on the right wheel brake assembly.

Attention is first directed to FIG. 1 which is a plan view showing my invention. Shown thereon is a left wheel adjuster assembly 14 and a right wheel adjuster assembly 16. These adjuster assemblies are preferably quite similar to the concept structure taught in U.S. Pat. No. 4,081,060. Adjuster assembly 14 includes a trunnion 18 and a slide bar 20 which is slidably insertable into the trunnion 18. One end of slide bar 20 is provided with a sleeve 32 through which a cross head pin 30 extends to connect the slide bar 20 to pull rods 28. One end of trunnion 18 is provided with the clevis 34 which is connected by clevis pin 36 to safety strap 26. As taught in U.S. Pat. No. 4,081,060, supra, it is sometimes necessary to adjust the distance between the pull rod 28 and the safety strap 26. This is easily done with the invention of that patent by use of a keeper lever 42 so that a keeper pin can be slid through the bores in trunnion 18 and the selected aperture 21 of the slide bar when the slide bar has been moved into the correct position within trunnion 18. The right hand adjuster assembly 16 is essentially identical to the left hand adjuster assembly 14 and includes a slide bar 24, a trunnion 22, keeper lever 23 and is used to connect the safety strap 40 to pull rod 38.

We have observed that after awhile in brake assemblies using the slide bar and housing member just described, there develops "play" in the various pins and pivot points of the brake mechanism. The locomotive wheels normally tend to slope slightly to the outside. Then, when the pivot points of the linkage system wear, the braking shoes will overhang, that is extend outwardly beyond the locomotive wheels so that the brake shoes are not in full contact as they should be. This can cause heat buildup to the point where it becomes a major problem and the locomotive may be required to be removed from operations until corrections are made.

We have designed a system, in the scenario just described, to prevent the brake shoes from riding to the outside and having the overhanging problem. We provide a tie bar 10, as shown in FIG. 1, between left hand adjuster assembly 14 and right hand adjuster assembly 16. A bracket 44 is provided on trunnion 18 of the left hand adjuster assembly and a pin 46 pivotally connects one end of tie bar 10 to the bracket 44. The other end of tie bar 10 is connected to bracket 45 which is welded or otherwise secured to trunnion 22. A pin 47 pivotally connects that end of the tie bar to the bracket 45. Tie bar 10 is rigid and preferably made of strong steel. With the tie bar connecting the left and right hand slack adjuster assembly and with each shoe having the tendency to shift to the outside, this rigid tie bar 10 will prevent lateral movement of either or both brake shoes. This will prevent overhang of the brake shoe and the brake shoe will remain in full contact as is required. This also prevents the big heat buildup which we mentioned previously. A nose cushion binder or safety hanger 48 is connected by bolts 50 to the motor nose cushion support. This is a safety feature so in the event one of the pins 46 or 47 or the supporting brackets should break, then the tie bar 10 will still be retained within the safety hanger 48 and will not be free to flop around and possibly cause damage.

Figure 3:
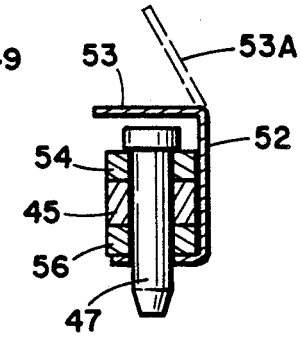
FIG. 3 is a view taken along the line 3—3 of FIG. 2.
Figure 2:
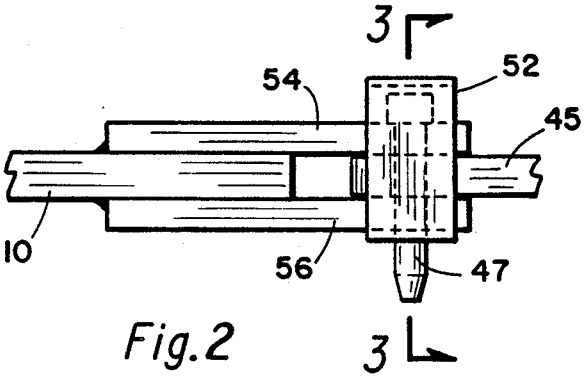
FIG. 2 is a view taken along the line 2—2 of FIG. 1.

FIGS. 2 to 5 are sectional views of the device of FIG. 1 and more clearly show some of the connections and relationship. As shown in FIGS. 2 and 3, pin 47 is provided with a safety retainer 52 to prevent the pin from bouncing out or being inadvertently removed. Saftey retainer 52 contains a flap 53 whicn when installed is in the dotted position 53A and then once the pin 47 is inserted into the position shown in FIG. 3 the flap 53 is bent over to the position shown therein.

Figure 4:
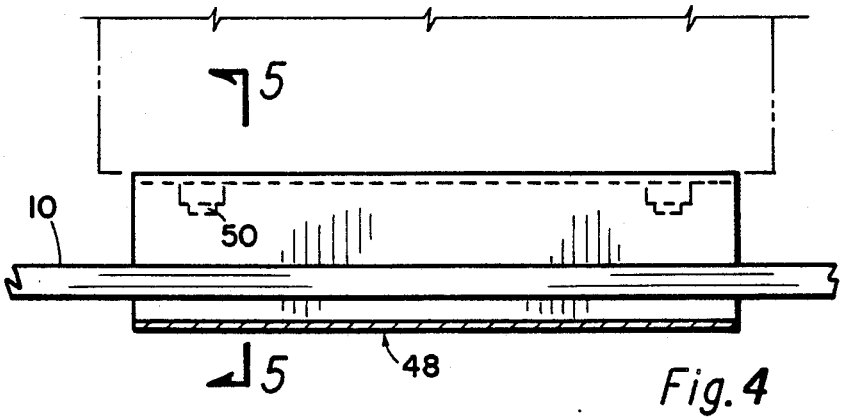
FIG. 4 is a view taken along the line 4—4 of FIG. 1.
Figure 5:
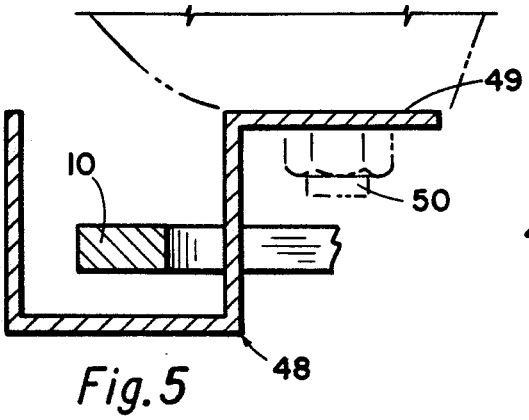
FIG. 5 is a view taken along the line 5—5 of FIG. 4.

FIGS. 4 and 5 show the tie bar 10 nestled in safety hanger 48 which is preferably a U-shaped strong steel element with a lateral sheet 49 which is secured by bolts 50 to the motor nose cushion support of the locomotive. This safety hanger 48 is to maintain the tie bar 10 in about the position shown in FIG. 1 in the event either pin 46 or 47 should fail. In case of such failure then the tie bar 10 cannot "get loose" and cause excessive damage.

Figure 6:
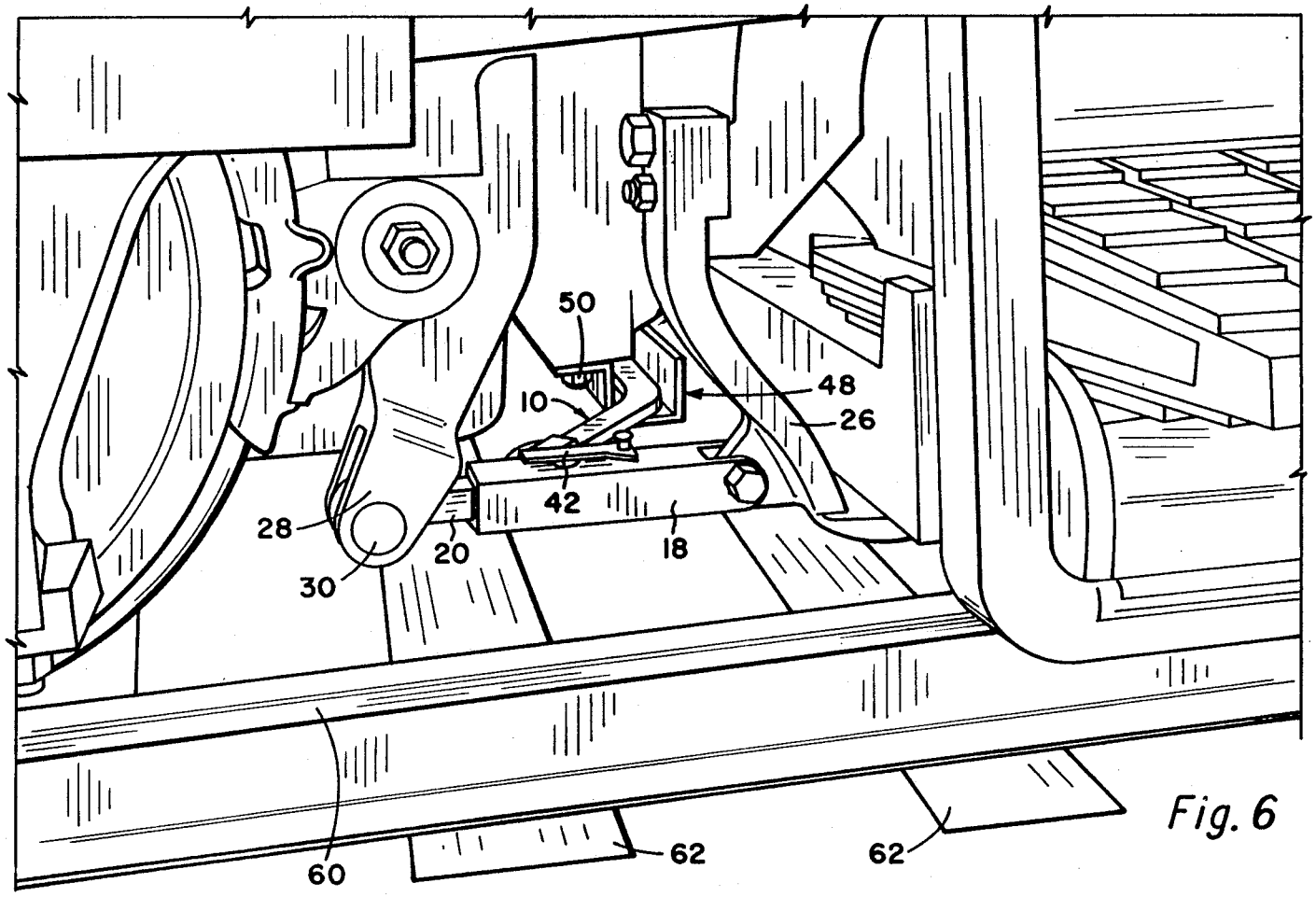
FIG. 6 is a perspective view of the safety tie bar of my invention connected to a brake adjuster assembly as seen from outside the truck.

Attention is now directed to FIG. 6 which is a perspective view of the part of the wheel cut away and shown thereon is a rail 60 mounted on ties 62. It shows the tie bar 10 connected to trunnion 18. The tie bar 10 is shown in safety hanger 48 which is attached by bolts 50 to the motor nose cushion support.

Tests have proven that by the use of our invention the tie bar holds the adjuster assemblies 14 and 16 in their proper relative position with respect to the brake shoes and wheels. By the use of our invention the brake shoes will not overhang the locomotive wheels. Thus the brake shoes are in full contact as they should be. This invention prevents heat buildup due to overhanging of the brake shoes because we have eliminated the overhanging. Thus our invention eliminates a condition, i.e., overhanging and heat builts up, which heretofore had plagued the industry.

With the tie or stabilizer bar routed behind the traction motor nose support brackets, the wheel and traction motor assembly can be removed without removing the brake adjuster assembly. This is a major advantage of our design. The nose cushion safety bracket is designed in such a way that should the stabilizer bar ever break away from the brake adjuster, it will not fall between the rails. The binder will support the stabilizer bar. In a preferred embodiment the stabilizer bar is designed sio that the height of the bar from the top of the rail is greater than the height of other parts of the truck in order to prevent anything from coming up between the rails and hitting the stabilizer bar.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

We claim:

1. A braking apparatus for use with a locomotive truck having a motor nose cushion support, comprising:

a left wheel adjuster assembly;

a right wheel adjuster assembly;

a first bracket affixed to said left wheel adjuster assembly and extending generally horizontally therefrom;

a second bracket affixed to said right wheel adjuster assembly extending generally horizontally therefrom, said first and second brackets each having a vertical opening therethrough;

a rigid tie bar extending between said left and right wheel adjuster assemblies;

a first vertical pin member pivotally connecting one end of said tie bar to said first bracket, and a second vertical pin member pivotally connecting the other end of said tie bar to said second bracket such that the adjuster assemblies are held a fixed distance apart; and means to slideably support said tie bar relative to said motor nose cushion.

2. A braking apparatus according to claim 1 wherein said means to support said tie bar comprises:

an elongated safety hanger of U-shaped cross-sectional configuration secured to the locomotive nose cushion support and slideably receiving said tie bar therein at the tie bar mid-portion intermediate said ends.

* * * * *